United States Patent [19]

Mathews

[11] 4,354,326

[45] Oct. 19, 1982

[54] TOY FLIP CAP

[76] Inventor: Kenneth D. Mathews, 1833 W. Ash St., Fullerton, Calif. 92833

[21] Appl. No.: 281,670

[22] Filed: Jul. 9, 1981

[51] Int. Cl.[3] ..... A63H 27/00

[52] U.S. Cl. ..... 46/74 D; 273/424

[58] Field of Search ..... 46/74 D; 273/424, 425, 273/428, 126 R; D21/85, 86

[56] References Cited

U.S. PATENT DOCUMENTS

| | | | |
|---|---|---|---|
| 4,016,854 | 4/1977 | Lehman | 46/74 D X |
| 4,152,863 | 5/1979 | Kubiatowicz | 46/74 D X |
| 4,203,249 | 5/1980 | Böhm | 46/74 D |
| 4,255,893 | 3/1981 | Anderson et al. | 46/74 D |

*Primary Examiner*—Robert Peshock
*Assistant Examiner*—Mickey Yu
*Attorney, Agent, or Firm*—Francis X. Lo Jacono

[57] ABSTRACT

A toy flip cap adapted to be sailed through the air by means of placing the cap between the thumb and the middle finger and then snapping the fingers, the cap thus being flipped outwardly to travel along various flight paths. The flip cap comprises an annular body defined by a substantially flat top wall having a flared peripheral depending wall. The peripheral wall is the portion of the cap that is held between the thumb and the middle finger, and it is designed to provide an aerodynamic lift by the force resulting from the snapping of the fingers.

3 Claims, 4 Drawing Figures

FIG. 1
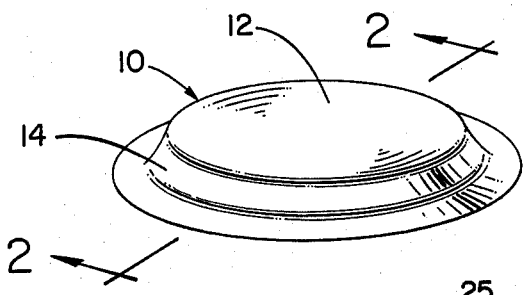
FIG. 4
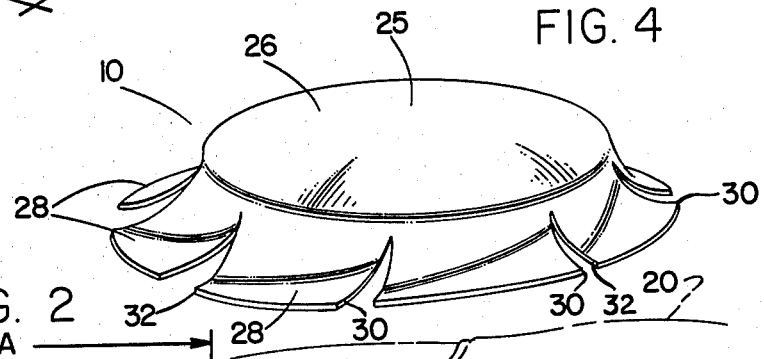
FIG. 2
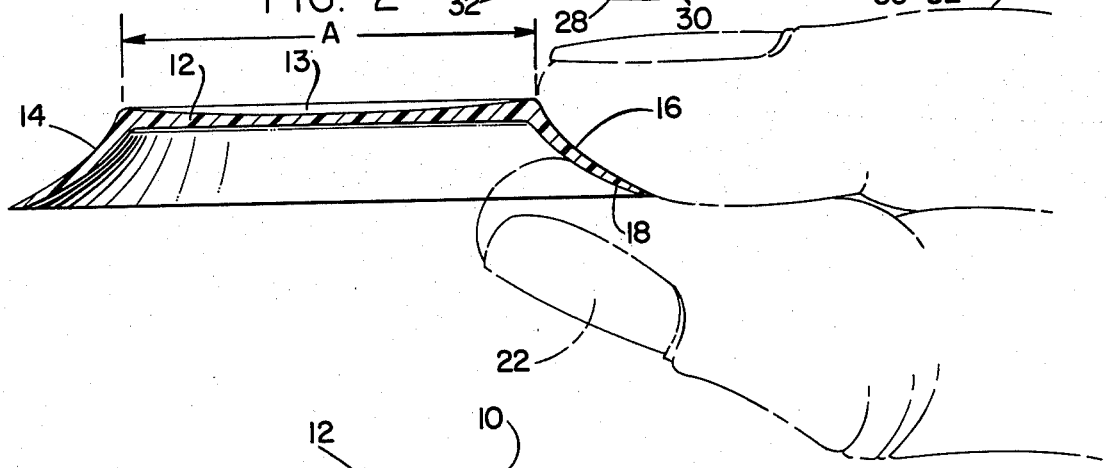
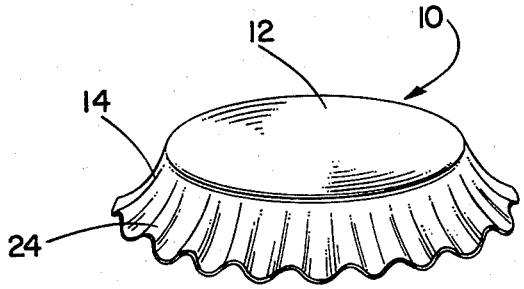
FIG. 3

TOY FLIP CAP

BACKGROUND OF THE INVENTION

1. Field of the Invention

This invention relates generally to a toy, and more particularly to a circular top adapted to be sailed in the air in an aerodynamic manner.

2. Description of the Prior Art

There are many types of flying toys known in the art, these having many different configurations. Some of these devices are designed with a circular plate formed generally with a convexed dome, and very often include an inwardly curved edge so as to be gripped by the hand or by most of the fingers. The operator thereof must throw the device with a particular side-arm motion in order to impart a sailing or flying action. This type of flying toy has a diameter of approximately six to twelve inches and requires the operator to use a considerable amount of force to generate a rotational speed to aid in the flight pattern. An example of such a toy which is well known in the art is marketed under the trademark "Frisbee".

SUMMARY OF THE INVENTION

In contrast to the above-mentioned devices known in the art, the present invention comprises a flip cap or top formed having an approximate diameter of three-quarters of an inch to one and one-half inch. The cap includes a substantially flat-top circular wall having an annular depending flange wall which, in one embodiment, is flared radially outward in order to provide a means by which the operator can grasp the toy between the thumb and the middle finger.

Thus, it is an important object of the invention to provide a disc-like sailing toy that can be readily flown through the air by a flick or snap of the thumb and the middle finger.

It is another object of this invention to provide a toy of this character that can be used by both children and adults alike by creating various games for playing enjoyment.

It is still another object of the invention to provide a toy of this character that is readily formed from most plastic materials, thereby providing a very inexpensive item for manufacture and sale.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of the preferred embodiment of the present invention;

FIG. 2 is an enlarged cross-sectional view thereof taken substantially along line 2—2 of FIG. 1, showing a thumb and middle finger.

FIG. 3 is a perspective view of an alternative arrangement whereby the annular flanged wall is shown having a corrugated configuration; and FIG. 4 is still another illustration of an alternative arrangement wherein the peripheral flange is divided into a plurality of twisted segments to create a lifting effect.

DESCRIPTION OF THE PREFERRED EMBODIMENT

Referring now to the drawing, there is illustrated a flip-cap toy according to the present invention, generally indicated at 10. The flip cap or top comprises a relatively thin circular disc-shaped body defined by a substantially flat-top wall 12 having a flared, peripheral, depending flange wall 14.

The body is perferably formed from a suitable plastic, such as a polymeric material of high-impact grade. However, it should be noted that a thin sheet composed from one of the various metals can also be employed, such as a light tin or aluminum.

As best seen in the illustration of FIGS. 1 and 2, the flip-cap body comprises the circular top wall 12 having a slightly concaved upper surface 13. This configuration aids in the aerodynamic flight of the cap. The peripheral flange 14 is bent downwardly and outwardly from the peripheral edge 15 of the concentric top wall 12.

The cross section of the body of cap 10 (seen in FIG. 2) shows the annular flange wall 14 having a curvilinear configuration, with an outer concave surface 16 and an inner convex surface 18, wherein the two opposing surfaces taper inwardly as the flange wall extends outwardly. Thus, a means is defined to impart an aerodonetic force by placing the tip of one's thumb (indicated at 20) against concave surface 16, and the tip of the middle finger 22 against the convexed surface 18.

Accordingly, by snapping the thumb and finger in a normal manner, the cap will be released with a sharp spinning force and can be made to sail long distances through the air.

Another embodiment is illustrated in FIG. 3, wherein the curvilinear flange wall is formed having a corrugated-like undulated surface 24. Such a surface configuration allows a greater spinning force to be imparted, and also provides varied flight patterns.

Referring now to FIG. 4, there is shown still another embodiment of the present invention comprising a cap-like body having a central top wall 25 formed as a dome-like top surface 26. The peripheral edge of top 26 is provided with a plurality of depending outwardly flared wing members 28. The wing members may be tapered as described and shown relative to the configuration of the cap illustrated in FIGS. 1 and 2.

Each wing member is dissymmetrically curved whereby the leading edge 30 is higher than the trailing edge 32. That is, each wing member is twisted to create a fan-like condition, thus providing a greater lifting effect to the top as it is spinning.

For best results, it is contemplated that the diameter of the cap (seen at A) be between three quarters of an inch to one and one-half inch.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

I claim:

1. A flip-top toy comprising:

a circular body member formed having an approximate diameter between three-quarters of an inch to one and one-half inch;

wherein said circular body includes a substantially flat top wall having an annular flange wall extending radially downward and outward from said flat top wall;

said flange having a curvilinear cross-sectional configuration defined by an outer concave surface and an inner convex surface, whereby said surfaces are tapered inwardly of each other as said flange wall extends radially outward;

said tapered surfaces being adapted to be positioned between an individual's thumb and middle finger, whereby the snapping of said thumb and middle finger results in an aerodynamic flight of said top through the air.

2. A flip-top toy as recited in claim 1, wherein said top wall is concaved.

3. A flip-top toy as recited in claim 1, wherein said top wall is convexed.

* * * * *